United States Patent [19]

Asaka

[11] Patent Number: 4,503,009

[45] Date of Patent: Mar. 5, 1985

[54] PROCESS FOR MAKING COMPOSITE MECHANICAL PARTS BY SINTERING

[75] Inventor: Kazuo Asaka, Chiba, Japan

[73] Assignee: Hitachi Powdered Metals Co., Ltd., Chiba, Japan

[21] Appl. No.: 489,358

[22] Filed: Apr. 28, 1983

[30] Foreign Application Priority Data

May 8, 1982 [JP] Japan ..... 57-77154

[51] Int. Cl.[3] ..... B22F 3/14

[52] U.S. Cl. ..... 419/6; 419/5; 419/48

[58] Field of Search ..... 419/5, 6, 48

[56] References Cited

U.S. PATENT DOCUMENTS 3,672,882 6/1972 Sagmuller et al. ..... 419/7

4,236,923 12/1980 Takahashi et al. ..... 419/48

OTHER PUBLICATIONS

Goetzel, "Treatise on Powder Metallurgy" vol. II, (1950), pp. 362–363.

*Primary Examiner*—Ben R. Padgett

*Assistant Examiner*—Anne Brookes

*Attorney, Agent, or Firm*—Burgess, Ryan & Wayne

[57] ABSTRACT

A process for making a mechanical part of a complicated profile by preparing a compact having a projection or shaft (hereinafter called the inner part) and a compact having relative recess or opening (hereinafter called the outer part) by the compression of iron base metal powders, and by fitting the inner part into the outer part followed by sintering. This process is characterized in that the said inner part contains carbon as an essential component in an amount that is larger than the carbon content of the said outer part by 0.2% by weight or higher.

1 Claim, 3 Drawing Figures

PROCESS FOR MAKING COMPOSITE MECHANICAL PARTS BY SINTERING

BACKGROUND OF THE INVENTION

The present invention relates to improvements in the so-called sinter bonding process for joining a plurality of green compacts together into a one piece sintered part.

The conventional brazing processes have generally made use of dimensional changes of green compacts due to sintering, viz., differences between the size of the green compacts and that of the sintered compacts at normal temperature.

Now assume that the dimensional changes of inner and outer parts, as defined in the appended claim, are designated as positive or negative when they expand or shrink.

To bond the inner part to the outer part, for example, the materials thereof have been chosen such that a dimensional change of the inner part is larger than that of the outer part, as is the case with the bonding of an inner part of Fe-7 to 15Cu (expansion) to an outer part of Fe-0.5 to 4Ni (contraction).

However, the conventional processes primarily rely upon mechanical joining which takes advantage of a so-called thermal-insert or shrink-fit mechanism, by which the integration of the inner and outer parts is not at all or or only partially achieved through the metal diffusion therebetween. This poses a problem in connection with the reliability of joining.

As a result of extensive studies made on the sintering process of various types of iron base sintered metals with the aid of a thermal dilatometer, however, it has been found that, a certain combination of the type and amount of additives gives rise to a reversal of the magnitude of dimensional changes of a sintered mass cooled down to normal temperature and a green compact exposed to a high-temperature region (in which the additives diffuse) during sintering, and that such a reversal phenomenon is observed only when there is a difference of 0.2% or higher in the carbon content between two green compacts if the amounts of other ingredients are the same. To avoid confusion, the dimensional change upon sintering and the dimensional change during sintering will hereinafter be referred to as the post change and the insintering change, respectively.

SUMMARY OF THE INVENTION

An essential feature of the present invention, based on the aforesaid findings, is that the carbon content of the inner part is larger than that of the outer part by 0.2% by weight or higher.

The present invention will now be explained further with reference to the following non-restrictive examples.

EXAMPLE 1

The test pieces to be bonded together were of the following predetermined shape and reference dimensions:

INNER PART: Cylindrical Body of $10\phi \times 30\phi \times 10$ mm

OUTER PART: Cylindrical Body of $30\phi \times 40\phi \times 5$ mm

Mixtures comprising iron, copper and graphite powders in the given ratios were prepared, and amply mixed with 0.5% of zinc stearate to obtain powdery mixtures A and B having the following composition. It should be noted that mixtures B and A were different only in that the graphite content of B was larger than that of A by 0.3%.

| Mixture | Iron | Copper | Graphite |
|---|---|---|---|
| A | Balance | 1.5% | 0.7% |
| B | Balance | 1.5% | 1.0% |

From mixtures A and B were prepared inner and outer compacts both having a density of 6.7 g/cm$^3$.

Hereinafter, the inner and outer compacts formed of mixture A will be designated as A.I and A.O. Likewise, the inner and outer compacts formed of mixture B will be designated as B.I and B.O.

The compacts of mixtures A and B were then sinterd at 1130° C. in an atmosphere of butane-modified gas. The thus sintered compacts had a post change of +0.23% (A) and +0.01% (B). This shows that the less the carbon content, the larger the expansion rate will be. According to that theory, therefore, preference should be given to a combination of A.I and B.O.

To substantiate that theory, several composite compacts of A.I/B.O and B.I/A.O were prepared in such a manner that a difference in size between the inner and outer compacts was divided into several values from positive (clearance fit) to negative (interference fit).

In the runs carried out when there was a need of interference fit, the minimum heating was applied to the outer compact(s), if required, in a range of 80° to 250° C. depending upon the magnitude of a difference in size, thereby to expand the inner diameter thereof.

Figure 1:
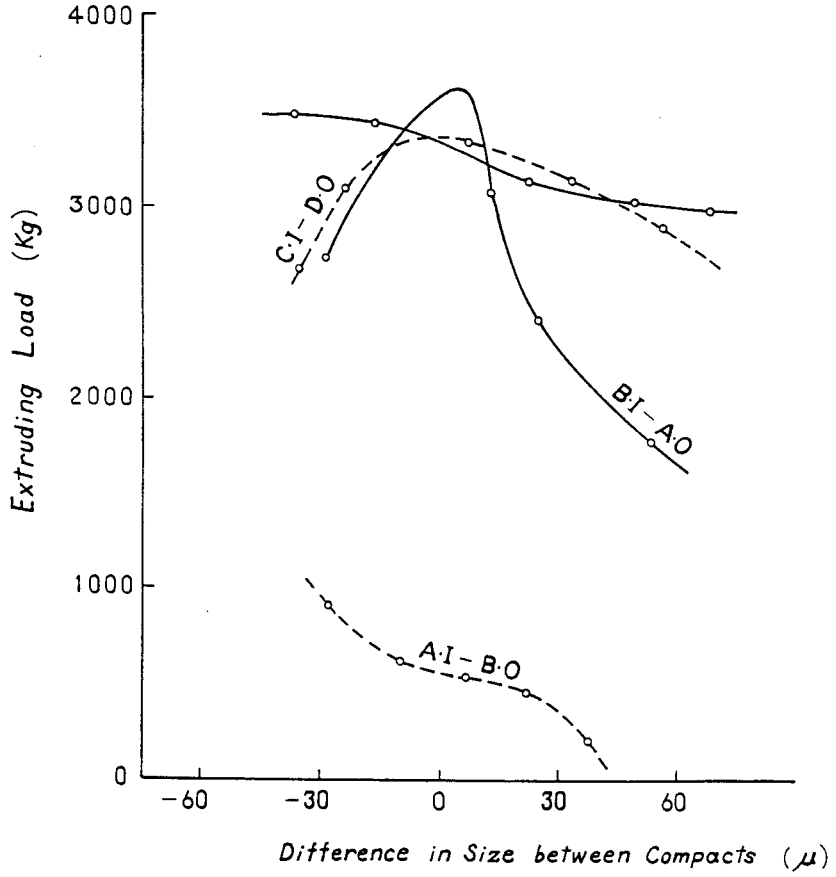
FIG. 1 is a graphical view showing the relationship between the difference in size between composite compacts and the bonding strength thereof.

These compacts were sintered at 1130° C. for 20 minutes in a furnace filled with cracked ammonia gas to determine the bonding strength of the obtained masses in the following manner: The outer parts of the sintered masses were fixed to the bed of a material testing machine through a spacer to determine the bonding strength in terms of a load the moment the inner part(s) were forced out of the outer part(s) under an axial load. The results are shown in FIG. 1, wherein a dotted line (--o--) stands for the prior art processes, and a solid line (—o—) the inventive process.

From the results, it has been found that the B.I-A.O combination has a bonding strength about three times that of the A.I-B.O combination in spite of the fact that the said combination is found to be difficult to bond since the dimensional change of the outer part exceeds the amount of expansion of the inner part. The reason may be explained from the graphical view of FIG. 2 as follows.

Figure 2:
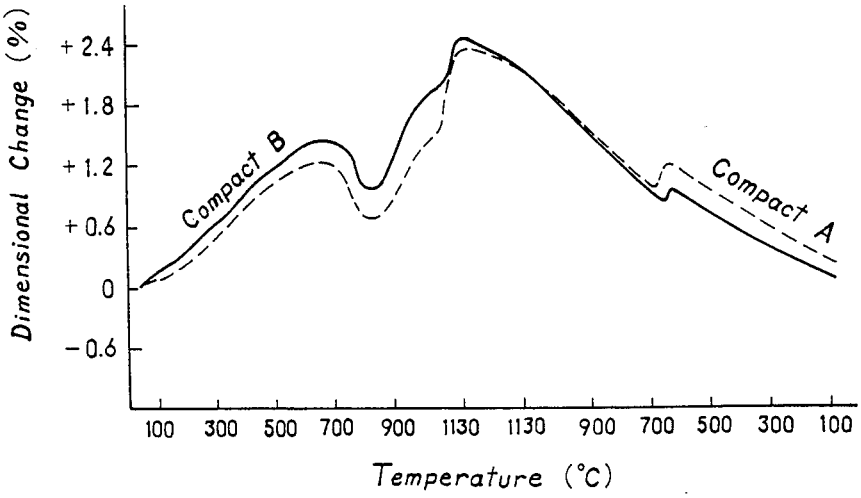
FIGS. 2 and 3 are graphical views wherein the thermal expansion curves of compacts having a variety of composition are compared with each other.

FIG. 2 illustrates, on the basis of the compacts, the dimensional changes of the compact of mixtures A and B, which were measured by separately setting them on a thermal dilatometer, heating them to 1130° C. at a rate of 10° C./min., maintaining them at that temperature for 20 min., and cooling them down at the same rate.

As will be appreciated from FIG. 2, compact B rather than A shows a larger coefficient of expansion by the time the sintering temperature is reached; the expansion curves of A and B cross each other at the point of transition from sintering to cooling; and compact A is larger than compact B in the amount of expansion at normal temperature, i.e., the change in size due to sintering.

With this in mind, it is found that, when there is no (zero) difference in size between A.I and B.O, the amount of expansion of the outer part is larger than that of the inner part by the time the sintering temperature is reached, so that sintering takes place in a state where the outer part can separate from the inner part. As a result, both parts would not sufficiently be alloyed together with a drop of bonding strength. That strength decreases with an increase in a positive difference in size may also be explained from this fact.

In the case of the B.I-A.O combination, on the other hand, the amount of expansion of the inner part is larger than that of the outer part during sintering. Thus, sintering proceeds in a state where both parts come in close contact with each other, with the result that they are alloyed together with an increase in bonding strength.

It should here be noted that strength drops, when the difference in size is negative, due to the influence of a tensile stress upon the unsintered outer part.

EXAMPLE 2

According to Example 1, powdery mixtures C and D were prepared, having the following composition. Mixtures C and D had a dimensional change due to sintering of +0.55% (expansion) and −0.11% (contraction), respectively.

| Mixture | Iron | Copper | Graphite |
|---|---|---|---|
| C | Balance | 3.0% | — |
| D | Balance | — | 0.8% |

Figure 3:
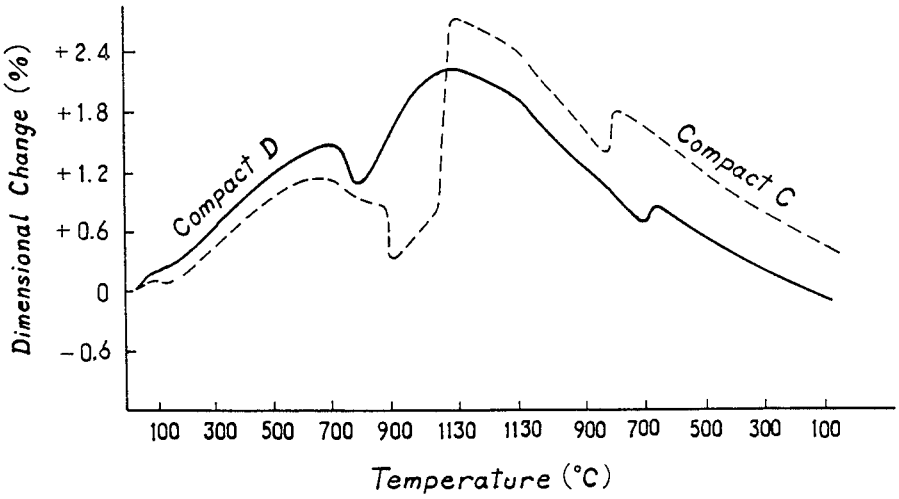

FIG. 3 shows the thermal expansion curves of the compacts formed of the said mixtures, and FIG. 1 shows the bonding strength of the composite sintered masses obtained by sintering several combinations thereof, wherein a dotted line (--o--) is the conventional process, and a solid line (—o—) the inventive prosess.

This example is similar to Example 1 in that there is a difference of no less than 0.2% in the carbon content between both mixtures and, as a result, the thermal expansion curves thereof cross each other, but is different therefrom in that the crossing of both curves takes place just before the point at which the sintering temperature is reached.

That is, the C.I-D.O combination, which departs from the purview of the present invention, may possibly be sintered in the later stage of sintering in a state where the inner and outer parts come in close contact with each other, and have a bonding strength close to that of the D.I-C.O combination according to the present invention. However, the C.I-D.O combination is estimated to be inferior to the combination according to the present invention, since it is less affected by a difference in size.

It should be understood that the foregoing reversal phenomenon, i.e., the crossing of the thermal expansion curves, is observed not only in the iron of copper base compacts but also in the iron or copper base compacts with other additives, on condition that the inner part has a carbon content of 0.2% by weight or more with respect to the outer part.

What is claimed is:

1. A process for making a mechanical part of a complicated profile which comprises: preparing a compact having a projection or shaft (hereinafter called the inner part) and a compact having a relative recess or opening (hereinafter called the outer part) by the compression of iron base metal powder; fitting the inner part into the outer part to form a fitted structure; and sintering the fitted structure to form the mechanical part, said process being characterized in that essentially the same base metal powder is used for both inner and outer parts, the iron base metal contains at least about 1.5 weight percent copper and the inner part contains carbon, as an essential component, in an amount that is larger than the carbon content of the outer part by at least 0.2% by weight.

* * * * *